US007248706B2

(12) United States Patent
Chuang

(10) Patent No.: US 7,248,706 B2
(45) Date of Patent: Jul. 24, 2007

(54) AUDIO-SIGNAL DETECTING DEVICE

(76) Inventor: Ching Kuo Chuang, 7, Lane 95, Sec. 1, Zhong Xing Road., Wugu Hsiang, Taipei County (TW)

( * ) Notice: Subject to any disclaimer, the term of this patent is extended or adjusted under 35 U.S.C. 154(b) by 824 days.

(21) Appl. No.: 10/697,924

(22) Filed: Oct. 29, 2003

(65) Prior Publication Data

US 2005/0094824 A1 May 5, 2005

(51) Int. Cl.
*H04R 5/00* (2006.01)

(52) U.S. Cl. ..... 381/72

(58) Field of Classification Search ..... 381/72, 381/74, 71, 73.1, 57, 106, 123
See application file for complete search history.

(56) References Cited

U.S. PATENT DOCUMENTS

2002/0012405 A1* 1/2002 Lee et al. ..... 375/300
2005/0157626 A1* 7/2005 Lin et al. ..... 369/124.11

* cited by examiner

*Primary Examiner*—Vivian Chin
*Assistant Examiner*—George Monikang
(74) *Attorney, Agent, or Firm*—Pro-Techtor Int'l Services

(57) ABSTRACT

An audio-signal detecting device to be disposed in a user's earmuffs for protecting his eardrums against noise of high-decibel level is comprised of a receiving unit, a first audio-signal amplifying unit, a second audio-signal amplifying unit, a peak-detecting and inverting unit, a first amplifying unit, a peak-detecting unit, a first switch, a delay unit, a second amplifying unit, a second switch, a third switch, an adjusting unit, a third audio-signal amplifying unit, and an output unit. In keeping communicable with outside world, when a noise greater than a predetermined decibel level is detected, this device is supposed to attenuate or reject it temporarily, then, after an RC-constant time period, recover to communicate automatically.

11 Claims, 3 Drawing Sheets

AUDIO-SIGNAL DETECTING DEVICE

BACKGROUND OF THE INVENTION

1. Field of the Invention

This invention relates generally to audio-signal detecting devices, and it relates more particularly to an audio-signal detecting device to be disposed in earmuffs for protecting a user' eardrums against any instantaneous external high-decibel audio signals when he is working in a high-noise site.

2. The Prior Arts

A shooting range or a machinery-processing workshop is known an extremely high noisy working site. When shooting or working there, people would wear earmuffs to obstruct unbearable noise in order not to get their eardrums hurt.

In the earmuffs of a shooter or a worker, there is usually arranged a processing device for receiving and processing external audio signals such that the shooter or the worker can communicate with outside people without needing taking off his earmuffs.

The earmuffs would protect a user's eardrums and allow him to communicate with people outside or keep himself informed of peripheral environmental states without needing taking off his earmuffs as mentioned though, unfortunately, the audio signals inputted to the conventional earmuffs are processed to get attenuated to some limited extent only, it doesn't work very much on noise high than 80 db.

SUMMARY OF THE INVENTION

The primary object of this invention is to eliminate the aforementioned defects by providing an audio-signal detecting device to be disposed in a user's earmuffs for automatically attenuating an overlarge high-decibel audio signal to even achieve a mute state for protection of the user's eardrums, and during the mute state, the communication state could be gradually restored by means of a time-constant delay charge process.

In order to realize above-said object, the audio-signal detecting device of this invention to be disposed in a user's earmuffs is comprised of: a receiving unit, a first audio-signal amplifying unit, a second audio-signal amplifying unit, a peak-detecting and inverting unit, a first amplifying unit, a peak-detecting unit, a first switch, a delay unit, a second amplifying unit, a second switch, a third switch, an adjusting unit, a third audio-signal amplifying unit, and an output unit.

For more detailed information regarding advantages or features of this invention, at least an example of preferred embodiment will be described below with reference to the annexed drawings.

BRIEF DESCRIPTION OF THE DRAWINGS

The related drawings in connection with the detailed description of this invention to be made later are described briefly as follows, in which.

DETAILED DESCRIPTION OF THE PREFERRED EMBODIMENT

Figure 1:
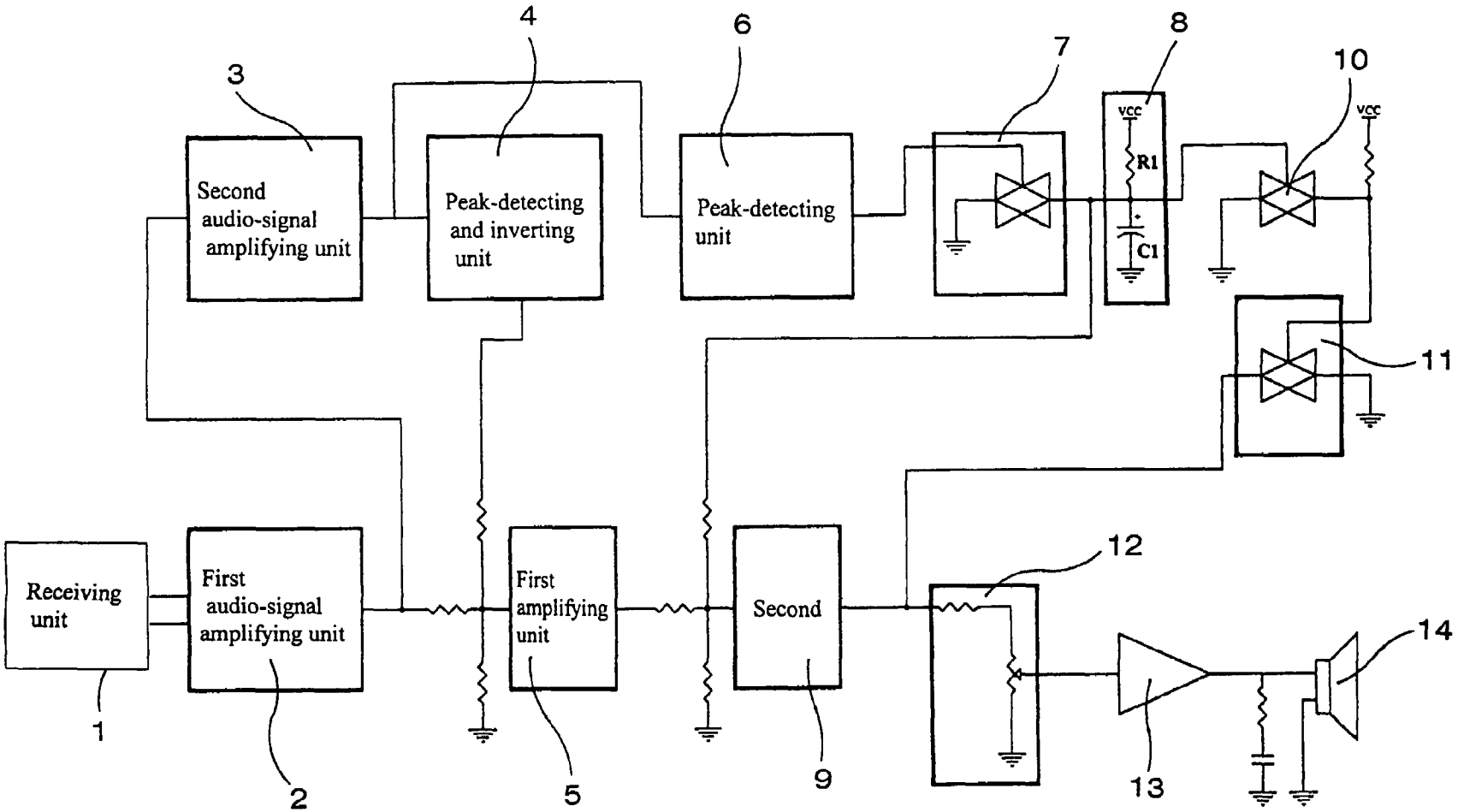
FIG. 1 shows a circuitry block diagram of this invention.

FIG. 1 shows a circuitry block diagram of this invention. As shown in FIG. 1, an audio-signal detecting device of this invention is comprised of: a receiving unit 1, a first audio-signal amplifying unit 2, a second audio-signal amplifying unit 3, a peak-detecting and inverting unit 4, a first amplifying unit 5, a peak-detecting unit 6, a first switch 7, a delay unit 8, a second amplifying unit 9, a second switch 10, a third switch 11, an adjusting unit 12, a third audio-signal amplifying unit 13, and an output unit 14. The audio-signal detecting device is disposed in a user's earmuffs for detecting input audio signals having a peak higher than a predetermined value. When such a peak is detected, the audio-signal detecting device is launched to intercept and attenuate or reject the input signals in the earmuffs to even enter a mute state for protecting a user's eardrums against high noise, and the control will be removed when the peak detected goes down below the predetermined value.

The mentioned receiving unit 1 composed of a microphone is provided for receiving external audio signals.

The first audio-signal amplifying unit 2 having its input end coupled with the output end of the receiving unit 1 is arranged to process the audio signals received by the receiving unit 1.

The second audio-signal amplifying unit 3 having its input end coupled with the output end of the first audio-signal amplifying unit 2 is employed to process the output signals of the first audio-signal amplifying unit 2.

The peak-detecting and inverting unit 4 having its input end coupled with the output end of the second audio-signal amplifying unit 3 is employed for detecting the inverting peak of output audio signals from the second audio-signal amplifying unit 3 and providing a bias voltage to the first amplifying unit 5 to thereby make output amplitude thereof fluctuated in accordance with the detected peak to hence secure the attenuation effect of the audio signals.

The first amplifying unit 5 having its input end coupled with the output end of the first audio-signal amplifying unit 2 and of the peak-detecting and inverting unit 4 is so arranged to receive the inverting peaks detected by the peak-detecting and inverting unit 4 for attenuating the audio signals.

The peak-detecting unit 6 having its input end coupled with the output end of the second audio-signal amplifying unit 3 is so arranged to detect the output audio-signal peaks from the second audio-signal amplifying unit 3 and provide a rated voltage to drive the first switch 7 when the detected peak is found greater than the predetermined decibel value.

The first switch 7 composed of an analog switch and having its input end coupled with the output end of the peak-detecting unit 6 is employed to receive the detected signal voltage greater than the predetermined decibel value.

The delay unit 8 composed of a resistor and a capacitor and having its input end coupled with the output end of the first switch 7 is designed to perform a charge effect by means of the resistor and capacitor in order to provide a bias voltage to the second amplifying unit 9, in which the delay unit 8 slows down the output signal, from smaller to bigger, of the second amplifying unit 9.

The second amplifying unit 9 composed of transistors and having its input end coupled with the output end of the first switch 7 and the input end of the delay unit 8 is employed to receive a delayed bias voltage caused by the delay unit 8 to therefore enlarge the output voltage gradually.

The second switch 10 composed of an analog switch and having its input end coupled with the output end of the delay unit 8 is arranged to receive the output signals of the delay unit 8.

The third switch 11 also composed of an analog switch and having its input end coupled with the output end of the second switch 10 is designed to ground the output end of the second amplifying unit 9 and thereby disable the third audio-signal amplifying unit 13 to therefore achieve a mute state when it is actuated.

The adjusting unit 12 composed of a variable resistor and having its input end coupled with the output end of both the second amplifying unit 9 and the third switch 11 is employed to adjust the magnitude of signals inputted to the third audio-signal amplifying unit 13.

The third audio-signal amplifying unit 13 having its input end coupled with the output end of the adjusting unit 12 is employed to enlarge the output signals of the adjusting unit 12.

The output unit 14 composed of either a buzzer or a speaker and having its input end coupled with the output end of the third audio-signal amplifying unit 13 is arranged to output the enlarged signals of the third audio-signal amplifying unit 13.

Figure 2A:
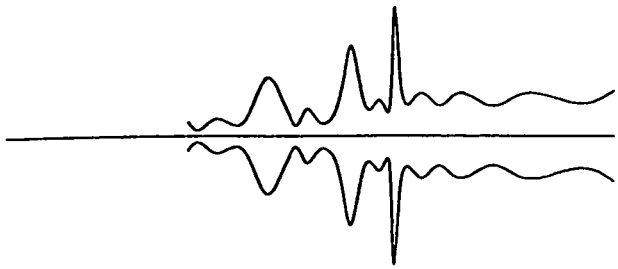
FIG. 2A shows the audio signals received by a receiving unit of this invention.
Figure 2B:
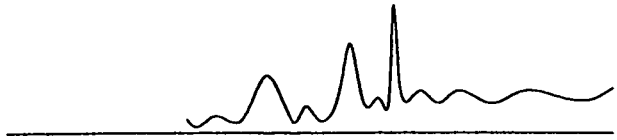
FIG. 2B is a schematic view showing the peak values of detected waveforms of this invention.
Figure 2C:
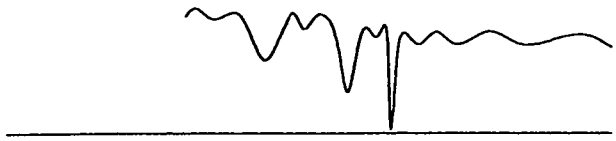
FIG. 2C is a schematic view showing the peak values of detected inverting waveforms of this invention.
Figure 2D:
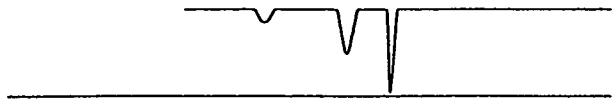
FIG. 2D is a schematic view showing the peak values of detected inverting output waveforms of this invention.
Figure 2E:
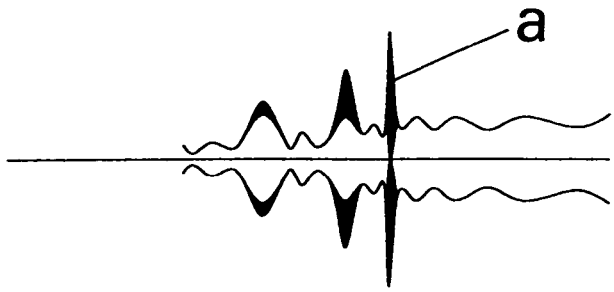
FIG. 2E is a schematic view showing the waveforms of a first amplifying unit and that of the original audio signals.

FIG. 1 and FIG. 2A through 2I represent a circuitry block diagram and detected signal waveforms of each block. As shown in the figures, after the receiving unit 1 has received an external audio signal (shown in FIG. 2A), the received signal is then forwarded to the first audio-signal amplifying unit 2 for processing. The enlarged signal at this time is inputted to both the second audio-signal amplifying unit 3 and the first amplifying unit 5. After enlarged in the second audio-signal amplifying unit 3, the signal is outputted to the peak-detecting and inverting unit 4 and the peak-detecting unit 6 respectively. The signal waveforms detected by the peak-detecting and inverting unit 4 are shown in FIG. 2B through 2D, revealing a bigger inverting output peak, a greater attenuating signal (shown in FIG. 2D). Now, the inverting output is compared with the audio-signal output of the first amplifying unit 5 (portion a in FIG. 2E represents the attenuating portion of an audio signal), where the output of the first amplifying unit 5 is variable depending on the detected peaks for achieving the attenuation effect.

Figure 2F:
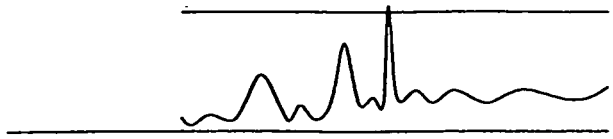
FIG. 2F is another schematic view showing the peak values of detected waveforms of this invention.
Figure 2G:
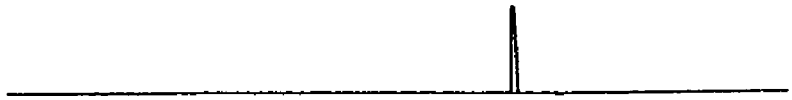
FIG. 2G is a schematic view showing the peak values of detected output waveforms of this invention.
Figure 2H:
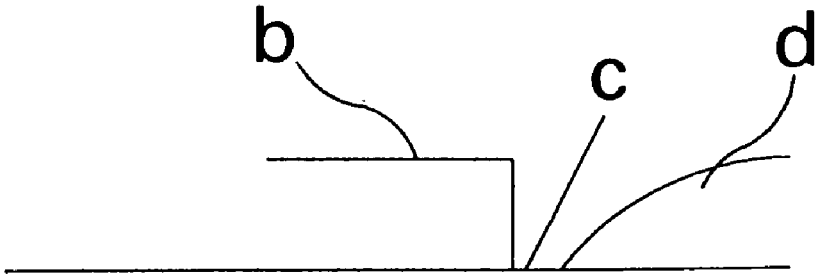
FIG. 2H is a schematic view showing a first switch and the waveform of a delay unit.
Figure 2I:
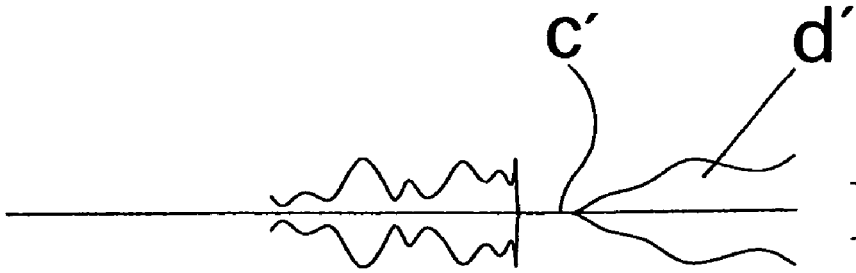
FIG. 2I is a schematic view showing the output waveforms of a third audio-signal amplifying unit.

The peak waveforms of the audio signals detected through the peak-detecting unit 6 are shown in FIGS. 2F and 2G. At this time, the peak-detecting unit 6 will provide a rated voltage (as portion b shown in FIG. 2H) to actuate the first switch 7 when the peak of signals is found greater than a predetermined value, and through the third switch 11 to ground the second amplifying unit 9, a mute effect could be secured (as portion c shown in FIG. 2H and portion c' shown in FIG. 2I). Now, the third audio-signal amplifying unit 13 does not output any audio signals at this moment to ensure the security of a user's eardrums.

In the mute duration, the charge effect of the delay unit 8 owing to RC time constant would make the output signals of the second amplifying unit 9 grow gradually (as portion d shown in FIG. 2H and portion d' shown in FIG. 2I) to finally allow the recovery of normal audio-signal output of the third audio-signal amplifying unit 13.

In the above described, at least one preferred embodiment has been described in detail with reference to the drawings annexed, and it is apparent that numerous changes or modifications may be made without departing from the true spirit and scope thereof, as set forth in the claims below.

What is claimed is:

1. An audio-signal detecting device to be disposed in earmuffs to attenuate or mute high-decibel audio signals inputted into the earmuffs, comprising:

a receiving unit for receiving external audio signals;

a first audio-signal amplifying unit having its input end coupled with the output end of said receiving unit for amplifying the output signals of said receiving unit;

a second audio-signal amplifying unit having its input end coupled with the output end of said first audio-signal amplifying unit for amplifying the output signals of said first audio-signal amplifying unit;

a peak-detecting and inverting unit having its input end coupled with the output end of the second audio-signal amplifying unit for detecting the signal peaks and the inverting output thereof;

a first amplifying unit having its input end coupled with the output end of said first audio-signal amplifying unit and of said peak-detecting and inverting unit for receiving the output signals of said peak-detecting and inverting unit and comparing them with the signals inputted to said selfsame amplifying unit in order to attenuate over-high audio signals;

a peak-detecting unit having its input end coupled with the output end of said second audio-signal amplifying unit for detecting the output audio-signal peaks from said second audio-signal amplifying unit;

a first switch having its input end coupled with the output end of said peak-detecting unit for receiving the signal voltage greater than a predetermined peak value detected by said peak-detecting unit;

a delay unit having its input end coupled with the output end of said first switch for receiving the output signal of said first switch to generate a charge effect;

a second amplifying unit having its input end coupled with both the output end of said first switch and the input end of said delay unit for enlarging the output voltage gradually according to the charge effect of said delay unit; and a third switch having its input end coupled with the output end of said delay unit, being designed to ground the output end of said second amplifying unit to prohibit signal output thereof and thereby attenuate audio signals at over-high decibel level, which is supposedly to get recovered following to the fade-in of the output signals from said second amplifying unit due to the charge effect caused by said delay unit.

2. The audio-signal detecting device according to claim 1, in which said receiving unit is a microphone.

3. The audio-signal detecting device according to claim 1, in which said first amplifying unit and said second amplifying unit are composed of a transistor.

4. The audio-signal detecting device according to claim 1, in which said first switch and said third switch are composed of an analog switch.

5. The audio-signal detecting device according to claim 1, in which said delay unit is composed of a resistor and a capacitor.

6. The audio-signal detecting device according to claim 1, in which said delay unit and said third switch are coupled with said second switch composed of an analog switch.

7. The audio-signal detecting device according to claim 1, in which the output end of said third switch and of said second amplifying unit are coupled with an adjusting unit.

8. The audio-signal detecting device according to claim 7, in which said adjusting unit is a variable resistor.

9. The audio-signal detecting device according to claim 1, in which the output end of said adjusting unit is coupled with a third audio-signal amplifying unit.

10. The audio-signal detecting device according to claim 9, in which the output end of said third audio-signal amplifying unit is coupled with an output unit.

11. The audio-signal detecting device according to claim 10, in which said output unit is either a buzzer or a speaker.

* * * * *